US007779766B2

(12) United States Patent
Mullen

(10) Patent No.: US 7,779,766 B2
(45) Date of Patent: Aug. 24, 2010

(54) THIEF MARKER

(76) Inventor: Joseph Mullen, 8 Robert Burns Court, Beith, Ayrshire (GB) KA15 IDN ( * ) Notice: Subject to any disclaimer, the term of this patent is extended or adjusted under 35 U.S.C. 154(b) by 1091 days.

(21) Appl. No.: 11/474,036

(22) Filed: Jun. 23, 2006

(65) Prior Publication Data

US 2007/0295431 A1 Dec. 27, 2007

(51) Int. Cl.
*E05G 1/00* (2006.01)
*A45C 1/06* (2006.01)

(52) U.S. Cl. ..... 109/25; 109/29; 150/134; 340/568.7; 340/571

(58) Field of Classification Search ..... 109/20, 109/25–34, 38–44, 58.5; 340/568.1, 568.7, 340/571; 383/5, 84; 150/101, 102, 131, 150/133, 134; 190/101
See application file for complete search history.

(56) References Cited

U.S. PATENT DOCUMENTS 1,567,065 A * 12/1925 Lawrence ..... 109/32
2,693,164 A * 11/1954 Bruchlos ..... 116/84
3,500,771 A * 3/1970 Macione et al. ..... 109/29
3,513,787 A * 5/1970 Wolf ..... 109/32
3,518,951 A * 7/1970 Wolf ..... 109/32
3,653,342 A * 4/1972 Chilton ..... 109/31
3,893,096 A * 7/1975 Tucci et al. ..... 340/571
4,061,249 A * 12/1977 Smith ..... 222/78
4,118,692 A * 10/1978 Fitchett ..... 340/542
4,394,644 A * 7/1983 Di Leo et al. ..... 340/571
4,853,676 A * 8/1989 Kitts ..... 340/543
4,885,570 A * 12/1989 Chien ..... 340/571
4,941,687 A 7/1990 Crane
5,059,949 A 10/1991 Caparoni et al.
5,613,712 A 3/1997 Jeffers
5,790,027 A * 8/1998 Chern ..... 340/568.7
5,952,920 A * 9/1999 Braddick ..... 340/568.1
6,283,182 B1 * 9/2001 Fedeli ..... 150/102
6,536,348 B1 * 3/2003 Gral ..... 102/293
6,568,336 B2 * 5/2003 Van Lint ..... 109/29
6,637,485 B1 * 10/2003 Sartena ..... 150/118

* cited by examiner

*Primary Examiner*—Lloyd A Gall
(74) *Attorney, Agent, or Firm*—Raymond M. Galasso; Galasso & Associates, L.P.

(57) ABSTRACT

This invention consists of a casing designed to appear like a purse or wallet. The casing also has a flap with a stud, an accompanying clasp, and a pressurized dye packet. It may also include false coins, currency and credit cards, and miscellaneous compartments, pockets and slits. To use this invention, a person simply places the casing into his or her pocket or carries the casing like a purse. If a thief steals the casing, the dye packet automatically discharges when the flap is opened separating the stud from the clasp. The indelible red dye marks the thief's body and/or clothing for later identification.

8 Claims, 1 Drawing Sheet

THIEF MARKER

CROSS REFERENCE TO RELATED APPLICATIONS

This Non-Provisional Patent Application does not claim priority to any U.S. provisional application or foreign application.

FIELD OF THE DISCLOSURE

The disclosures made herein relate generally to wallets and purses with dye packets. The invention discussed herein is in the general classification of theft prevention systems.

BACKGROUND

Theft is an ongoing problem throughout the United States and abroad. Theft is responsible for countless amounts of economic loss. Many consumers spend money on guns, mace, pepper spray or other weapons to protect themselves from theft. However, often a user of these types of weapons is unfamiliar with the operation of them. This can result in them harming themselves or allowing a thief to overpower them to gain control of the weapon. Currently, no suitable device exists to protect an individual from theft through non-violent means while also aiding in capture after the thief strikes.

Hence, there is a need in the art for a device that allows a user to trick a thief into believing a wallet or purse is authentic while also marking the thief and his clothes for later identification and capture.

SUMMARY OF THE DISCLOSURE

Thief Marker consists of a cloth or leather material and dye packet. Thief Marker is designed to look like a man's wallet or woman's purse. The wallet or purse can be filled with fake credit cards, coins and money that are designed to appear as realistic as possible. For example, the money, coins and credit cards would be of similar weight, size and color as real currency, coins or credit cards.

The principal object of this invention is to provide a fake wallet or purse that can fool a thief into believing it is the real thing.

Another object of this invention is to provide a fake wallet or purse with a dye packet that will stain a thief to allow identification after it discharges.

Yet another object of this invention is to provide a fake wallet or purse that can contain tear gas, pepper spray or other chemical to aid in immobilizing and apprehending thiefs.

DETAILED DESCRIPTION OF THE DRAWINGS

Thief Marker is comprised of at least some of the following: a material fashioned into the shape of a purse or wallet, a flap with a stud and accompanying clasp, and a pressurized dye packet. It may also include false coins, currency and credit cards, and miscellaneous compartments, pockets and slits.

Figure 1:
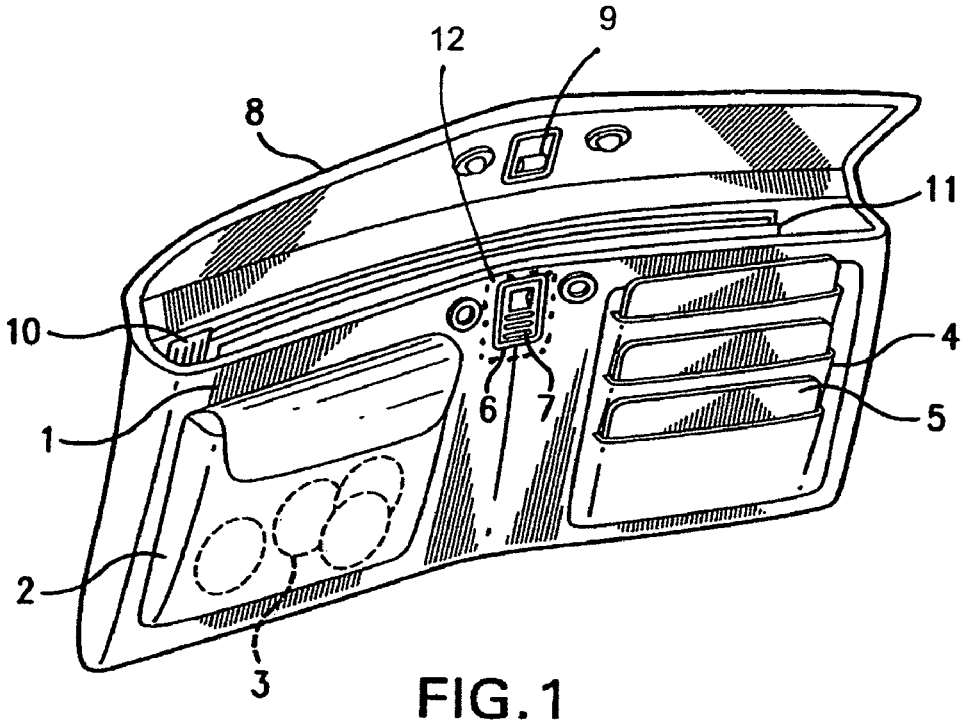
FIG. 1 depicts a perspective view of one embodiment of the invention shaped like a wallet.

In the preferred embodiment of the invention, shown in FIG. 1, a rectangular, leather casing 1 shaped like a wallet contains a pocket 2 with false coins 3 on one side and several compartments 4 to hold false credit cards 5 on the other side. In the center of the casing, a pressurized dye packet 12 with a one-way valve and containing colored dye (not pictured) is located. The pressurized dye packet 12 is underneath a clasp 6 that has holes 7 permeating through the clasp. The holes allow for the pressurized dye packet 12 to expel red smoke and dye when activated. The casing 1 also has a flap 8 with a stud 9 located in the center. The stud 9 interacts with the clasp 6 when the casing 1 is closed and prevents the pressurized dye packet 12 from discharging while the casing is closed. When the stud 9 is removed from the clasp 6, the pressurized dye packet 12 is activated causing red smoke and dye to be emitted. The casing 1 also has a slit 10 extending the length of the top of the casing 1. The slit 10 contains false currency 11.

The colored dye used in the pressurized dye packet is similar to those used by banks and financial institutions. The dye packet releases an aerosol mixture of red smoke and red dye (1-methylaminoanthraquinone) that can stain skin and clothing and is difficult to remove.

The preferred embodiment of the wallet would have dimensions of roughly two to three inches in height and three to four inches in length.

Figure 2:
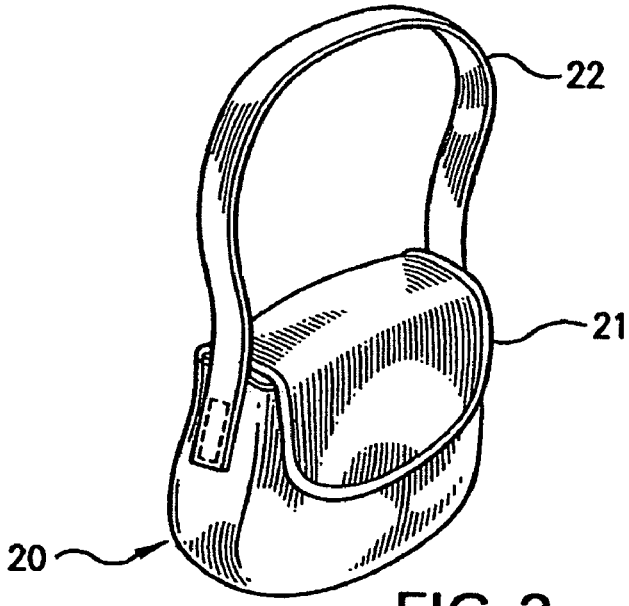
FIG. 2 depicts a perspective view of another embodiment of the invention shaped like a purse.

In FIG. 2, a casing 20 shaped like a purse with a flap 21 and a strap 22 are designed to work in a similar manner as the wallet described in FIG. 1. The casing 20 will also contain false coins (not pictured), false credit cards (not pictured), false currency (not pictured), pockets (not pictured) and compartments (not pictured). The casing 20 also has a pressurized dye packet (not pictured) with a one-way valve and containing colored dye (not pictured). The pressurized dye packet is underneath a clasp (not pictured) that has holes (not pictured) permeating through the clasp. The clasp is approximately centrally located on the casing 20 beneath the flap 21. The flap 21 also has a stud (not pictured) in approximately the center of the flap 21. The stud interacts with the clasp in the same manner as described in FIG. 1 to prevent discharge of the pressurized dye packet when the flap 21 is closed.

To use Thief Marker, a user simply places the wallet shaped casing into his or her pocket or carries the purse shaped casing. If a thief steals the wallet shaped casing or purse shaped casing, the dye packet automatically discharges when the flap is opened separating the stud from the clasp. The indelible red dye marks the thief's body and/or clothing. The dye will aid in identifying the thief and act as a deterrent to other thieves who will be mindful of the product.

The components of Thief Marker may vary widely but will likely utilize some type of cloth or other material for the wallet casing or purse casing and plastic for at least some of the components.

The plastic used in the production will ideally be selected for durability and longevity. Thermoplastics are commonly used in the manufacturing of components similar to those used in this invention. Polyethylene, polypropylene, and other similar thermoplastic materials would be among those with the necessary traits. Members of this family are recognized universally as being versatile and of high quality.

It should be obvious that while this product will most frequently be used by the general public, it also could be used by law enforcement. In alternate embodiments of the invention, tear gas or pepper spray could be included in the pressurized dye packet to immobilize a thief. It should also be obvious that any type or color dye capable of leaving a lasting stain on clothing and/or skin could be utilized in this invention. It should further be understood that any suitable sized or shaped casing will satisfy the spirit of this invention. It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A theft deterrent system comprising:

(a) a wallet-shaped casing made of a vinyl material;

(b) a flap with a stud located thereon and attachable to the casing;

(c) a clasp on the casing;

(d) at least one hole permeating through the clasp; and (e) a pressurized dye packet located beneath the clasp; wherein said stud interacts with said clasp when the casing is closed and prevents the pressurized dye packet from discharging.

2. The theft deterrent system of claim 1 wherein the casing is approximately rectangular.

3. The theft deterrent system of claim 1 wherein the casing is approximately oval.

4. The theft deterrent system of claim 1 wherein one side of the casing has a pocket and a plurality of compartments and the casing has a slit extending approximately the length of the top of the casing.

5. The theft deterrent system of claim 4 wherein the pocket contains at least one false coin, the plurality of compartments contain at least one false credit card, and the slit contains at least one type of false currency.

6. The theft deterrent system of claim 1 wherein the pressurized dye packet beneath the clasp contains a mixture of red smoke and red dye.

7. The theft deterrent system of claim 1 wherein the pressurized dye packet contains tear gas.

8. A theft deterrent system comprising:

(a) a rectangular, wallet-shaped casing made of leather;

(b) a flap with a stud approximately centrally located thereon and attached to the casing;

(c) a clasp on the casing;

(d) a plurality of holes permeating through the clasp;

(e) a pressurized dye packet located beneath the clasp and containing a mixture of red smoke and red dye; wherein said pressurized dye packet disperses through said holes;

(f) one side of said casing further having a pocket containing at least one fake coin and a plurality of compartments containing at least one fake credit card and said casing having a slit extending approximately the length of the top of the casing and containing at least one type of false currency.

* * * * *